US008701813B2

(12) United States Patent
Shimizu et al.

(10) Patent No.: US 8,701,813 B2
(45) Date of Patent: Apr. 22, 2014

(54) TWO-WHEELED MOTOR VEHICLE

(75) Inventors: Satoru Shimizu, Wako (JP); Takumi Sakamoto, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 422 days.

(21) Appl. No.: 13/002,009

(22) PCT Filed: Jun. 24, 2009

(86) PCT No.: PCT/JP2009/061476

§ 371 (c)(1),
(2), (4) Date: Dec. 29, 2010

(87) PCT Pub. No.: WO2010/001777

PCT Pub. Date: Jan. 7, 2010

(65) Prior Publication Data

US 2011/0108345 A1 May 12, 2011

(30) Foreign Application Priority Data

Jun. 30, 2008 (JP) ..... P2008-171900

(51) Int. Cl.
*B62D 61/02* (2006.01)

(52) U.S. Cl.
USPC ..... 180/219; 180/309

(58) Field of Classification Search
USPC ..... 180/219, 309
See application file for complete search history.

(56) References Cited

U.S. PATENT DOCUMENTS

| | | | | |
|---|---|---|---|---|
| 4,896,504 | A * | 1/1990 | Matsui | 60/313 |
| 4,986,239 | A * | 1/1991 | Oishi | 123/406.74 |
| 6,655,134 | B2 * | 12/2003 | Nakayasu et al. | 60/324 |
| 6,832,511 | B2 * | 12/2004 | Samoto et al. | 73/114.36 |
| 2002/0050415 | A1 * | 5/2002 | Kawamoto | 180/219 |
| 2002/0112470 | A1 * | 8/2002 | Yamada et al. | 60/290 |
| 2005/0056010 | A1 * | 3/2005 | Momosaki et al. | 60/312 |
| 2005/0189166 | A1 * | 9/2005 | Kikuchi et al. | 181/237 |
| 2007/0105691 | A1 * | 5/2007 | Sayman et al. | 477/121 |

FOREIGN PATENT DOCUMENTS

| | | | |
|---|---|---|---|
| JP | 1-116285 | A | 5/1989 |
| JP | 8-61040 | A | 3/1996 |
| JP | 3242240 | B2 | 12/2001 |
| JP | 2002-138886 | A | 5/2002 |
| JP | 2003-74426 | A | 3/2003 |
| JP | 2005-240714 | A | 9/2005 |

* cited by examiner

*Primary Examiner* — J. Allen Shriver, II
*Assistant Examiner* — Conan Duda
(74) *Attorney, Agent, or Firm* — Birch, Stewart, Kolasch & Birch, LLP

(57) ABSTRACT

A two-wheeled motor vehicle (10) provided with a throttle grip (25) rotated by the driver to change the degree of opening of a throttle valve (31), and also with an exhaust valve (34) which, when a throttle ratio which is a ratio of the angle of operation of the throttle grip to the maximum rotation angle of the throttle grip is between zero and a predetermined value, reduces noise emitted from an engine.

10 Claims, 11 Drawing Sheets

START
ST11
a1 ≦ V ≦ a2 ?
NO
YES
ST12
V1←V
ST13
START TIMER
ST14
T ≧ t0 ?
NO
YES
ST15
V2←V
ST16
| V1 − V2 | ≦ α ?
NO
YES
ST17
b1 ≦ θ ≦ b2 ?
NO
YES
ST18
LOW-NOISE TRAVEL MODE
ST19
NORMAL TRAVEL MODE
END
END

TWO-WHEELED MOTOR VEHICLE

TECHNICAL FIELD

The present invention relates to a two-wheeled motor vehicle provided with a noise-reduction device.

BACKGROUND ART

As in ordinary vehicles, two-wheeled motor vehicles have a silencer or muffler provided in an exhaust passage. The muffler can offer certain reduction in noise produced by the exhaust on the motor vehicle. However, while traveling in a densely populated urban area, the two-wheeled motor vehicle is required to achieve a further noise reduction than as it achieves during the travel in a sparsely populated suburban area.

In general, the length and flow-passage area of an exhaust passage are determined based on the rated output of an engine. Accordingly, it may occur that when the two-wheeled motor vehicle is traveling at a low speed with low engine output, the length or the flow-passage area of the exhaust passage becomes excessively large and the engine efficiency is reduced. To avoid this problem, a prior technology relying on the use of an exhaust valve has been proposed. The exhaust valve is disposed in an exhaust passage and operable to reduce the flow-passage area or the length of the exhaust passage when the engine power output is small, thereby preventing a reduction in the engine efficiency.

An exhaust valve so configured as to reduce the cross-sectional area of a flow passage promises a certain level of noise reduction effect, as will be discussed below.

Exhaust noise produced by the engine is emitted along an exhaust passage. When the exhaust valve closes the exhaust passage, part of the exhaust noise is blocked from escaping to the outside by the exhaust valve. A certain level of noise reduction effect can thus be attained.

Such exhaust valve is disclosed in, for example, Japanese Patent Publication (JP-B2) No. 3242240. The exhaust valve disclosed in JP 3242240 B2 is disposed in an intermediate part of the exhaust passage of a two-wheeled motor vehicle. The degree of opening of the exhaust valve is proportional to the rotation angle of a throttle grip of the two-wheeled motor vehicle.

The relation between the rotation angle of the throttle grip and the degree of opening of the exhaust valve is that when the rotation angle of the throttle grip increase from zero to a predetermined angle, the degree of opening of the exhaust valve is approximately proportional to the rotation angle of the throttle grip. Due to such proportional relation, the exhaust valve begins to open simultaneously with the start of rotation of the throttle grip. With this arrangement, the noise becomes large even when the two-wheeled motor vehicle is traveling at a low constant speed.

In view of the travel in a closely populated urban area, it is highly desirable that the noise produced from an engine of the two-wheeled motor vehicle during the travel at a low constant speed is as low as possible.

PRIOR ART LITERATURE

Patent Document

Patent Document 1: Japanese Patent Publication (JP-B2) No. 3242240

SUMMARY OF INVENTION

Object Sought to be Solved by Invention

It is an object of the present invention to provide a technique which is capable of reducing the noise produced from an engine when a two-wheeled motor vehicle is traveling at a low constant speed.

Means to Solve the Object

According to an aspect of the present invention, as recited in claim 1, there is provided a two-wheeled motor vehicle, comprising: a body frame; an engine mounted to the body frame for driving a rear wheel; an exhaust passage extending from the engine for discharging exhaust gas from the engine; a muffler provided at an outlet of the exhaust passage for reducing exhaust noise; an intake passage connected to the engine for supplying intake air into the engine; a throttle valve disposed in the intake passage for adjusting the amount of fuel gas to be supplied to the engine; a throttle grip rotatable by the driver to change the degree of opening of the throttle valve; and a noise-reduction device which, when a throttle ratio which is a ratio of the angle of operation of the throttle valve to a maximum rotation angle of the throttle grip is between zero and a predetermined value, reduces noise emitted from the engine.

According to the invention as recited in claim 2, the noise-reduction device comprises an exhaust valve which is configured to change a cross-sectional area of the exhaust passage and also to reduce the noise most efficiently when the exhaust valve has a minimum degree of opening.

According to the invention as recited in claim 3, the noise-reduction device comprises an intake valve which is configured to change a cross-sectional area of the intake passage and also to reduce the noise most efficiently when the degree of opening of the intake valve is minimal.

According to the invention as recited in claim 4, the noise-reduction device comprises an ignition device which is configured to advance ignition timing when the throttle ratio is between zero and the predetermined value.

According to the invention as recited in claim 5, the ignition timing of the ignition device is advanced when the predetermined value of the throttle ratio is 5 to 25%.

According to the invention as recited in claim 6, the minimum degree of opening of the exhaust valve is a degree of opening corresponding to a valve-opening area which is 15 to 35% of a valve-opening area achieved when the exhaust valve is fully opened.

According to the invention as recited in claim 7, the minimum degree of opening of the intake valve is a degree of opening corresponding to a valve-opening area which is 30 to 60% of a valve-opening area achieved when the intake valve is fully opened.

Advantageous Effects of the Invention

According to the invention as recited in claim 1, when the throttle ratio of the throttle grip is between zero and the predetermined value, the noise-reduction device operates to reduce the noise. When the two-wheeled motor vehicle is traveling at a low constant speed, the throttle ratio is between zero and the predetermined value, and the noise-reduction device operates.

According to the invention, there is provided a technique which is capable of reducing the noise produced from an engine when a two-wheeled motor vehicle is traveling at a low constant speed.

According to the invention as recited in claim 2, the exhaust valve is kept with a minimum degree of opening so as to reduce the noise. The exhaust valve also serves to improve the engine efficiency. The exhaust valve is thus able to achieve an effect to improve the engine efficiency and an effect to reduce the noise.

According to the invention as recited in claim 3, the intake valve is kept with a minimum degree of opening so as to reduce the noise. The intake valve also serves to improve the engine efficiency. The intake valve is thus able to achieve an effect to improve the engine efficiency and an effect to reduce the noise.

According to the invention as recited in claim 4, the ignition timing is advanced. When the two-wheeled motor vehicle is not in an accelerated condition, the engine load is low and, hence, the degree of opening of the throttle valve is small and the amount of fuel gas supplied to the combustion chamber is reduced accordingly. In this instance, if the ignition timing is advanced, a smaller amount of fuel gas will be subjected to combustion for a longer time than as usual. As a consequence, only a reduced amount of unburned gas is produced, which can eliminate combustion in the exhaust passage and does not pose any risk to increase the noise.

According to the invention, it is possible to reduce the noise by advancing the ignition timing.

Adjustment of the ignition timing can easily be achieved by using a permanently-installed ignition device. This means that noise reduction can be achieved without incurring additional cost.

According to the invention as recited in claim 5, the predetermined value of the throttle ratio is 5 to 25%. When the two-wheeled motor vehicle is traveling at a low constant speed, the rotation angle of the throttle grip corresponds to a throttle ratio of 5 to 25%. With this throttle ratio, the noise-reduction device is prompted to operate with the result that the noise can be reduced.

According to the invention as recited in claim 6, the minimum degree of opening of the exhaust valve is set to a degree of opening corresponding to a valve-opening area which is 15 to 35% of a valve-opening area achieved when the exhaust valve is fully opened. By thus setting the valve-opening area of the exhaust valve, the noise is blocked from propagating to the outside and, hence, the noise produced by the engine can be efficiently reduced.

According to the invention as recited in claim 7, the minimum degree of opening of the intake valve is set to a degree of opening corresponding to a valve-opening area which is 30 to 60% of a valve-opening area achieved when the intake valve is fully opened. By thus setting the valve-opening area of the intake valve, the noise is blocked from propagating to the outside and, hence, the noise produced by the engine can be efficiently reduced.

MODE FOR CARRYING OUT THE INVENTION

Certain preferred embodiments of the present invention will be discussed below with reference to the accompanying drawings.

First Embodiment

A first embodiment of the present invention will be described below with reference to the accompanying drawings.

Figure 1:
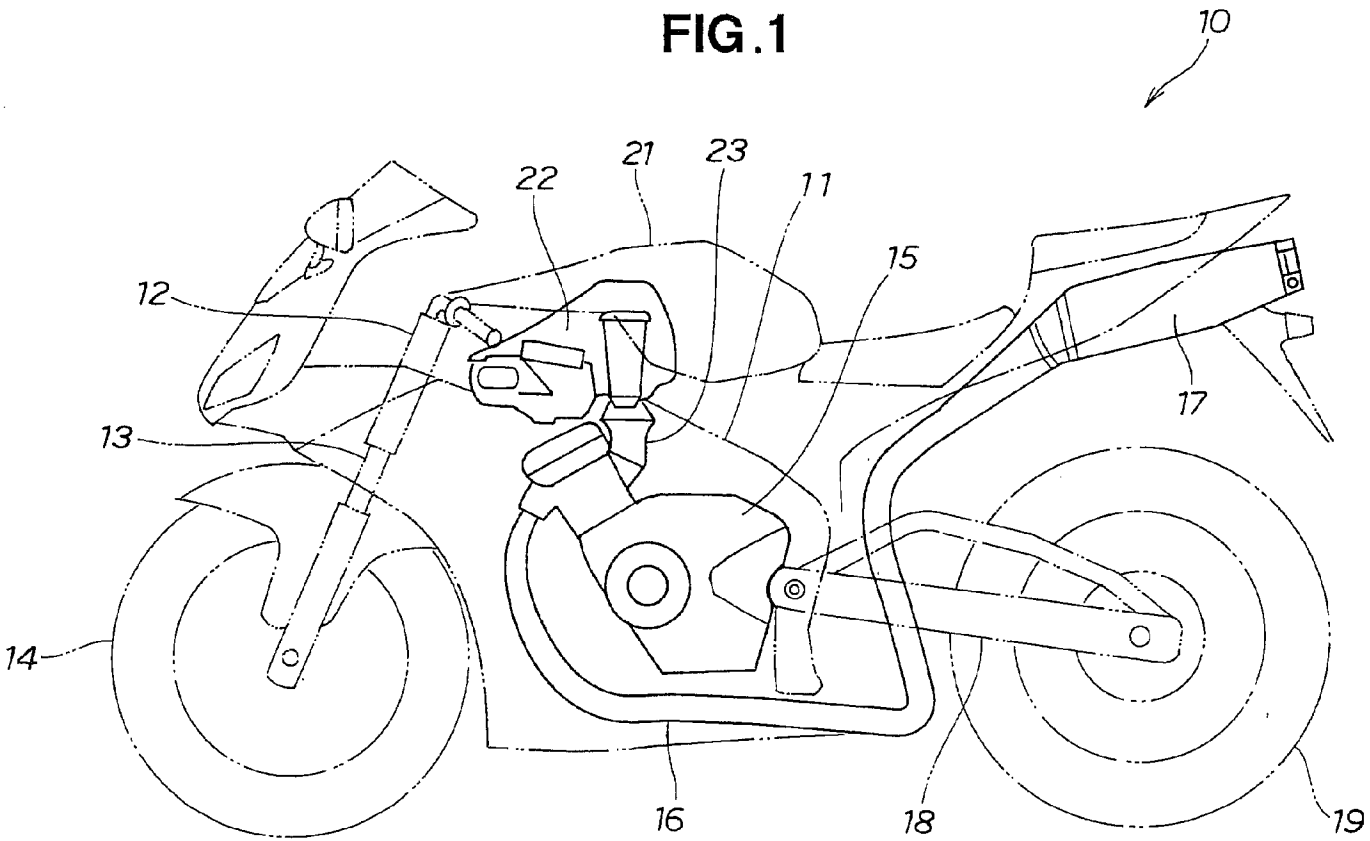
FIG. 1 is a left side view of a two-wheeled motor vehicle provided with a noise-reduction mechanism or device according to the present invention.

As shown in FIG. 1, a two-wheeled motor vehicle 10 generally comprises a body frame 11, a telescopic front fork 13 mounted to a head tube 12 provided at a front part of the body frame 11, a front wheel 14 rotatably mounted to a lower part of the front fork 13, an engine 15 mounted to the body frame 11 in a suspended state, an exhaust passage 16 extending from the engine 15, a silencer or muffler 17 mounted to a rear end of the exhaust passage 16, a swing arm 18 extending rearwards from the body frame 11, and a rear wheel 19 rotatably mounted to a rear end of the swing arm 18. The engine 15 may be of any type of internal combustion engine.

A fuel tank 21 is disposed on the body frame 11, and an air cleaner 22 is disposed between the fuel tank 21 and the engine 15 for taking in and filtering fresh air. An intake passage 23 extends from the air cleaner 22 and is connected to the engine 15 at a front end thereof.

Figure 2:
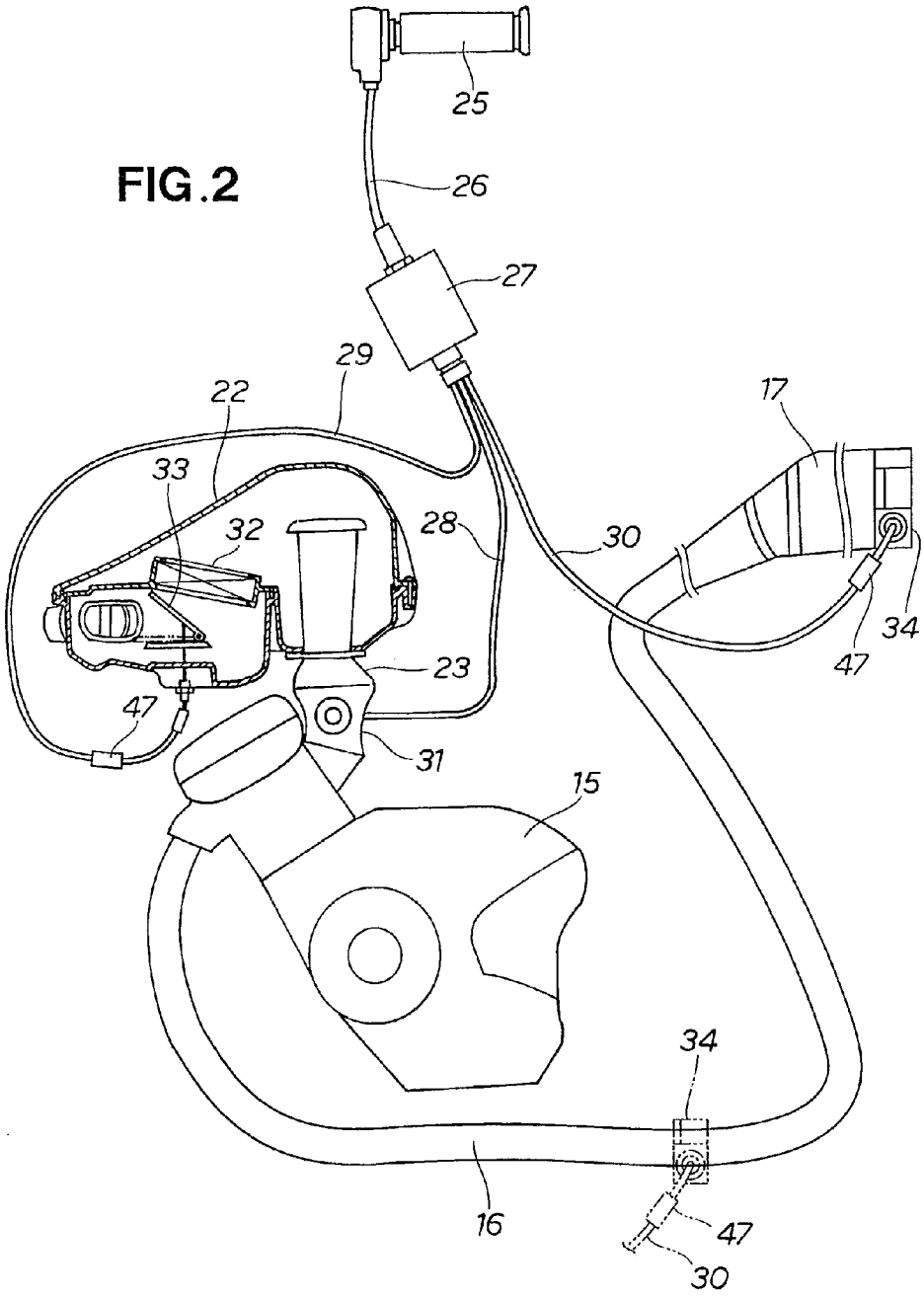
FIG. 2 is a diagrammatical view showing the general configuration of a noise-reduction device according to a first embodiment of the present invention.

A description will next be made about a throttle grip, which is gripped and rotated by the driver and has a throttle cable extending therefrom. As shown in FIG. 2, a throttle grip 25 is adapted to be operated by the driver, and a main cable 26 extends from the throttle grip 25. A front end of the main cable 26 is connected to a junction box 27 from which first, second and third cables 28, 29 and 30 extend.

A throttle valve 31 is disposed in an intermediate portion of the intake passage 23 for adjusting the amount of fuel gas to be supplied to the engine 15. The first cable 28 is connected to the throttle valve 31.

The air cleaner 23 has a built-in air-cleaner element 32 for removing foreign substances from the fresh air, and is provided with an intake valve 33 for variably changing the cross-sectional area of the intake passage 23. The intake valve 33 may be built in the air cleaner 22, or alternatively, it may be disposed in the intake passage 23 extending from the air cleaner 22. The second cable 29 is connected to the intake valve 33.

The muffler 17 is provided with an exhaust valve 34 for variably changing the cross-sectional area of the exhaust passage 16. The exhaust valve 34 may be built-in the muffler 34, or alternatively, it may be disposed in an intermediate portion of the exhaust passage 16. The third cable 30 is connected to the exhaust valve 34.

The throttle ratio of the throttle grip 25 during low speed traveling will next be described with reference to FIG. 3. The throttle ratio (%) is determined by an angle of operation of the throttle grip 25 rotated by the driver, which is divided by a maximum rotation angle of the throttle grip 25.

Figure 3:
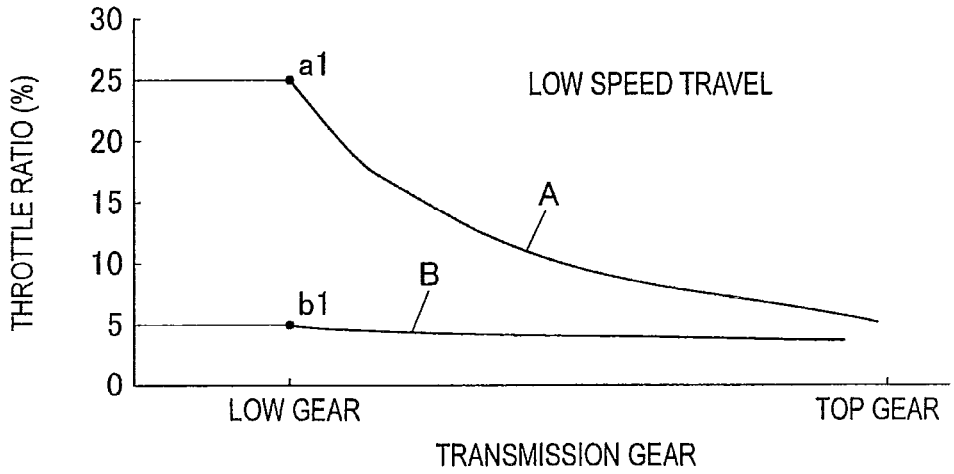
FIG. 3 is a graph explanatory of a predetermined value relating to a throttle grip of the two-wheeled motor vehicle.

A curve "A" shown in FIG. 3 represents a relation between the engine having a small capacity or displacement and the throttle grip. A point "a1" on the curve "A" indicates a start-up of the two-wheeled motor vehicle. With the small-capacity engine, the throttle grip is turned so that the throttle ratio increases to 25%, thereby providing an engine output required starting up the two-wheeled motor vehicle. In the case where the two-wheeled motor vehicle is to be driving at a low constant speed after the start-up of the same, the throttle ratio of the throttle grip decreases gradually as the position of the transmission gear is shifted toward a top gear side.

A curve "B" shown in FIG. 3 represents a relationship between the engine having a large capacity or displacement and the throttle grip. A point "b1" on the curve "B" indicates a start-up of the two-wheeled motor vehicle. With the large-capacity engine having a large engine output, a startup of the two-wheeled motor vehicle is possible to achieve when the throttle grip has been turned to realize a throttle ratio of 5%. A throttle ratio smaller than 5% will fail to keep a constant speed and, accordingly, for the large-capacity engine the 5%-throttle ratio is kept regardless of the position of the transmission gear.

The two-wheeled motor vehicle with small-capacity engine performs driving at a low constant speed when the throttle ratio of the throttle grip is between zero and 25%. Alternatively, the two-wheeled motor vehicle with large-capacity engine performs driving at a low constant speed when the throttle ratio is between zero and 5%.

Figure 4:
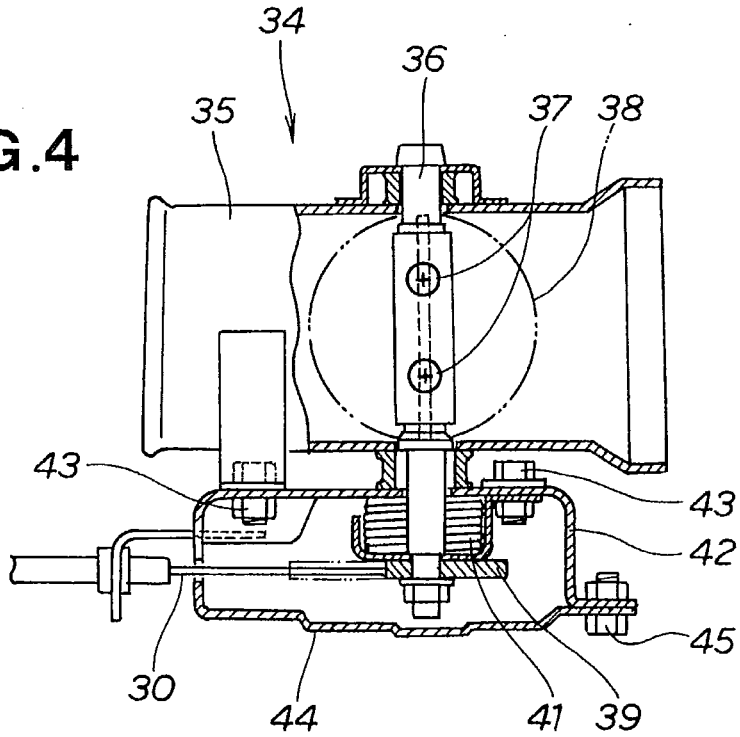
FIG. 4 is a cross-sectional view of an exhaust valve of the two-wheeled motor vehicle.

Next, the configuration of the exhaust valve 34 will be described below with reference to FIG. 4. As shown in FIG. 4, the exhaust valve 34 is in the form of a butterfly valve, which includes a tubular valve housing 35, a valve shaft 36 inserted through the valve housing 35 transversely across a flow passage defined in the valve housing 35, and a valve element 38 of circular plate-like configuration fixed to the valve shaft 36 by a pair of screws 37. The exhaust valve 34 is of the non-closed type, which is configured to allow a leakage of more than 15% of the exhaust gas even when the degree of opening is zero.

A lever 39 is mounted to one end of the valve shaft 36, and a front end of the third cable 30 is connected to the lever 39. When the third cable 30 is pulled, the lever 39 turns the valve shaft 36 in a valve-opening direction. The valve shaft 36 is provided with a return spring 41 so that when a pull on the third cable 30 is released, the valve shaft 36 is automatically turned in a valve-closing direction by the force of the return spring 41.

The return spring 41 and the lever 39 are received in a protective case 42, and the protective case 42 is attached to the valve housing 35 by means of a plurality of screw fasteners 43. A lid 44 is attached by a screw fastener 45 to the protective case 42 so as to close an open end of the protective case 42. With the lid 44 thus attached, the protective case 42 is substantially protected against invasion by foreign substances.

A description will next be made about the principle of a lost motion mechanism which is configured to block transmission of the movement of a driving member to a driven member for a given time period at the initial stage of the movement of the driving member.

Figure 5:
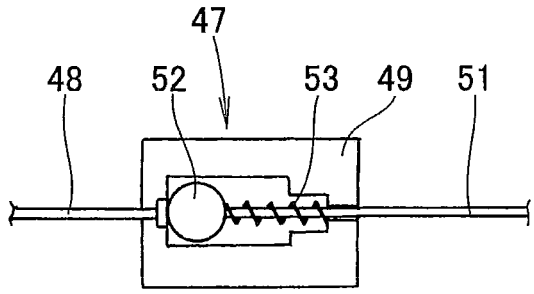
FIG. 5 is a diagrammatical view showing the principle of a lost-motion mechanism incorporated in a throttle cable.

As shown in FIG. 5, the lost motion mechanism 47 includes a case 49 connected to an end of a driving cable 48, a ball 52 connected to an end of a driven cable 51 and movably received in the case 49 such that the ball 52 is movable by a predetermined distance relative to the case 49, and a return spring 53 acting between the ball 52 and the case 49 and urging the ball 52 to return to its original position shown in FIG. 5.

Figure 6:
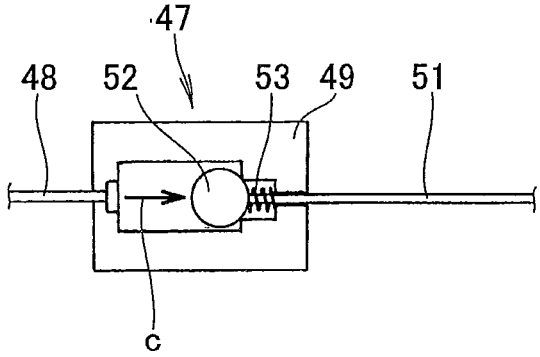
FIG. 6 is a diagrammatical view showing an operation of the lost-motion mechanism.

In FIG. 5, the driven cable 51 is not subjected to a large tensile force via the driving cable 48, and the ball 48 is held in its original position located adjacent to the end of the driving cable 48 anchored to the case 49. When the driving cable 48 is pulled, a tension on the driven cable 51 tends to increase. In this instance, however, the return spring 53 yields or deforms into an axially compressed configuration because the case 49 moves in the same direction as the direction of movement of the driving cable 48 being pulled. As the driving cable 48 is further pulled, an internal part of the case 69 which is located remotely from the driving cable 48 is brought into contact with the ball 52, as shown in FIG. 6. During that time, the driven cable 51 remains stationary and, as viewed from the driving cable 48, the ball 52 has moved or displaced from its original position by a predetermined distance "c" shown in FIG. 6. Further pulling operation of the driving cable 48 causes the driven cable 51 to move together with the driving cable 48 in the same direction as the direction of movement of the driving cable 48. As thus far described, the motion of the driven cable 51 lags behind the motion of the driving cable 48 by a time period corresponding to the predetermined distance "c", and such lag in motion between the driving cable 48 and the driven cable 51 is called as a lost motion.

As shown in FIG. 2, the lost motion mechanism 47 is incorporated in each of the second cable 29 and the third cable 30. When the throttle grip 25 is turned and the throttle ratio increases from zero to a predetermined value, the first cable 28 is pulled and the throttle valve 31 is operated to open in such a manner as to realize a valve-opening degree corresponding to the throttle ratio. On the other hand, the intake valve 33 and the exhaust valve 34 begin to open with a time delay or lag provided by the respective lost motion mechanisms 47 incorporated into the second and third cables 29, 30.

Figure 7:
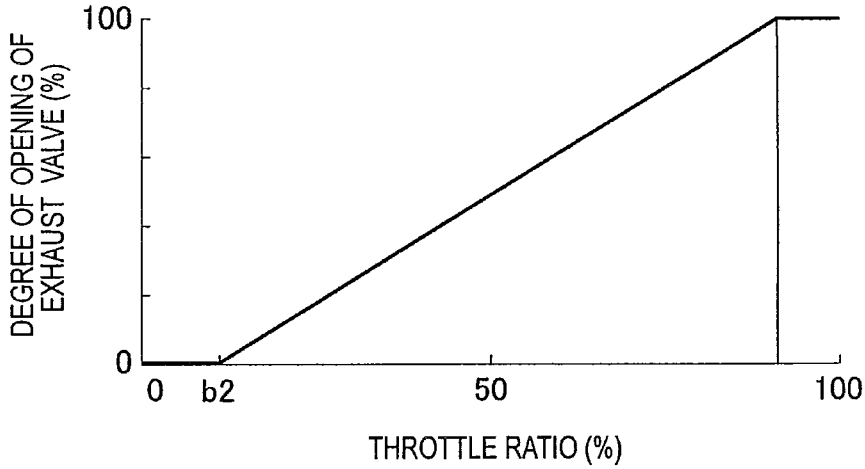
FIG. 7 is a graph showing the correlation between the throttle ratio of the throttle grip and the degree of opening of the exhaust valve.

The behavior of the exhaust valve 34 will next be described with reference to FIG. 7. As shown in FIG. 7, during a period when the throttle ratio of the throttle grip increases from zero to a predetermined value b2, the degree of opening of the exhaust valve 34 is maintained at zero by virtue of the operation of the lost motion mechanism 47. For the throttle ratios greater than the value b2, the degree of opening of the exhaust valve 34 increasers in direct proportion to the throttle ratio as a first-degree polynomial function of the throttle ratio.

The throttle ratio value b2 is set, for example, in the range of 5 to 25% with respect the maximum rotation angle of the throttle grip.

While the throttle ratio of the throttle grip is between zero and the b2 value, the exhaust valve is kept to exhibit a minimum degree of opening. The minimum degree of opening of the exhaust valve is such a degree of opening, which corresponds to a valve-opening area that is 15 to 35% of a valve-opening area achieved when the exhaust valve is fully opened.

Figure 8:
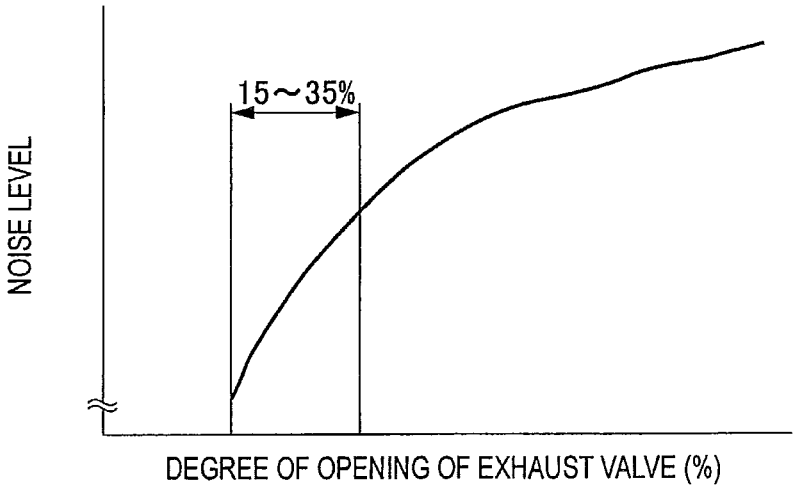
FIG. 8 is a graph showing the correlation between the degree of opening of the exhaust valve and the noise level.

As shown in FIG. 8, the noise level is the lowest when the degree of opening of the exhaust valve corresponds to a valve-opening area, which is 15 to 30% of the entire valve-opening area of the exhaust valve. This could be considered that the exhaust noise propagating through the exhaust passage is shut off or blocked by the exhaust valve.

While the throttle ratio of the throttle grip is between zero and the b2 value, a sufficient noise reduction effect can be attained by keeping the degree of opening of the exhaust valve at a value corresponding to a valve-opening area, which is 15 to 35% of the entire valve-opening area. If the valve-opening area of the exhaust valve exceeds 35%, only a limited noise reduction effect can be obtained. Alternatively, if the valve-opening area of the exhaust valve is less than 15%, the engine output will be negatively affected. It is therefore desirable that the degree of opening of the exhaust valve should preferably be maintained at a value corresponding to a valve-opening area, which is in the range of 15 to 35% of the entire valve-opening area of the exhaust valve.

The above-mentioned advantageous effects can be also expected for the intake valve.

Figure 9:
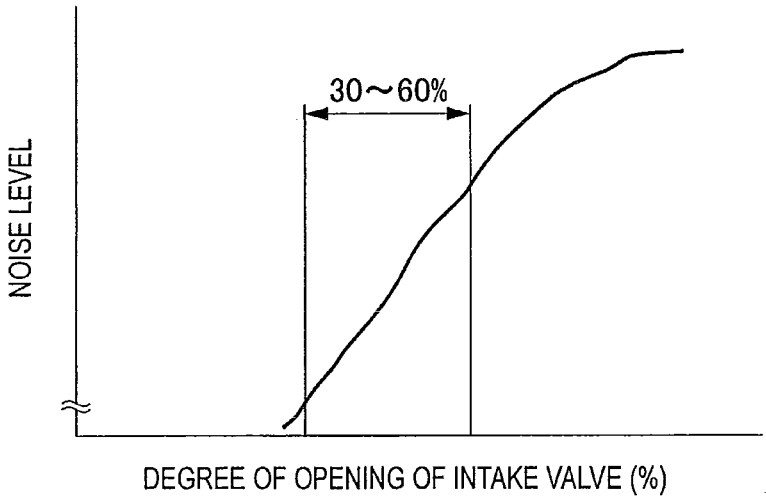
FIG. 9 is a graph showing the correlation between the degree of opening of an intake valve and the noise level.

As shown in FIG. 9, the noise level becomes lowest when the degree of opening of the intake valve corresponds to a valve-opening area, which is in the range of 30 to 60% of the entire valve-opening area of the intake valve. This could be considered that exhaust noise propagating through the intake passage is shut off or blocked by the intake valve.

While the throttle ratio of the throttle grip is between zero to the b2 value, a sufficient noise reduction effect can be attained by maintaining the degree of opening of the intake valve at a value corresponding to a valve-opening area, which is 30 to 60% of the entire valve-opening area of the intake valve. If the valve-opening area exceeds 60%, only a limited noise reduction effect can be achieved. Alternatively, if the valve-opening area is less than 30%, the engine output will be negatively affected. It is therefore desirable that the degree of opening of the intake valve should preferably be maintained at a value corresponding to a valve-opening area, which is 30 to 30% of the entire valve-opening area of the intake valve.

A description will be made about another form of lost motion mechanism, which requires less number of structural components than that of the lost motion mechanism 47 shown in FIG. 5.

Figure 10:
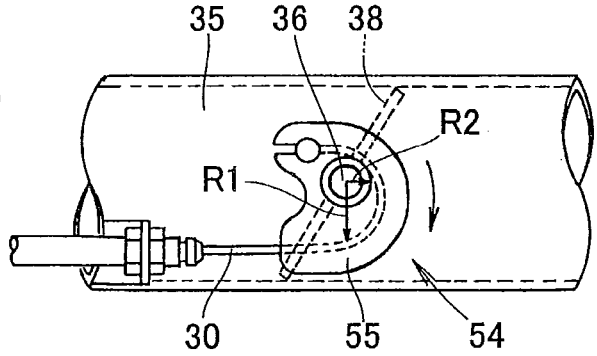
FIG. 10 is a diagrammatical view showing a modified form of the exhaust valve.

As shown in FIG. 10, the lost motion mechanism 54 includes a pulley drum 55 attached to the valve shaft 36. To the pulley drum 55, one end of the third cable 30 is connected. The pulley drum 55 is in the form of an eccentric cam, which is configured to provide a large turning radius R1 at an initial stage of pulling operation of the third cable 30 and a small turning radius R2 at a final stage of pulling operation of the third cable 30. The eccentric cam (pulley drum) 55 has a varying turning radius reducing continuously from the value R1 to the value R2.

Figure 11:
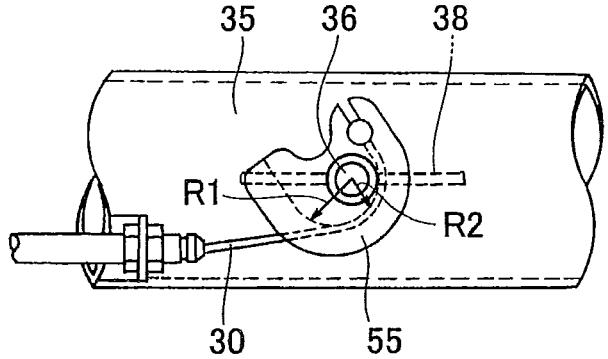
FIG. 11 is a diagrammatical view showing an operation of the modified exhaust valve shown in FIG. 10.

With the eccentric cam (pulley drum) 55 thus configured, when the third cable 30 is pulled at a constant speed, the valve shaft 36 turns slowly in early stages of turning motion of the eccentric cam 55 and, as shown in FIG. 11, the valve shaft 36 turns quickly at a final stage of turning motion of the eccentric cam 55.

Figure 12:
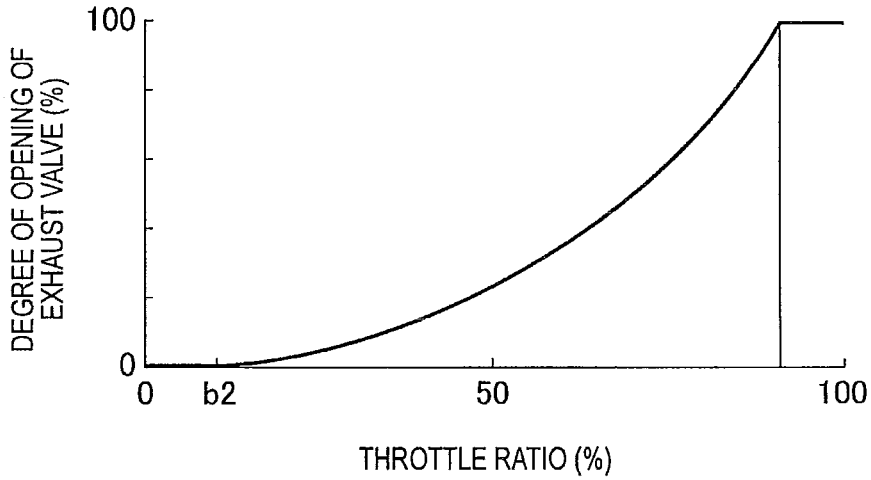
FIG. 12 is a graph showing the correlation between the throttle ratio of the throttle grip and the degree of opening of the exhaust valve shown in FIG. 10.

As shown in FIG. 12, when the throttle ratio of the throttle grip is between zero to the b2 value, the exhaust valve opens very little. When the throttle ratio of the throttle grip exceeds the b2 value, the exhaust valve begins to open rapidly and greatly. It will be appreciated that when the throttle ratio is between zero to the b2 value, a sufficient noise reduction effect can be attained by maintaining the degree of opening of the exhaust valve at a value corresponding to a valve-opening area, which is 15 to 30% of the entire valve-opening area of the exhaust valve. Much the same is true on an intake valve provided with the lost motion mechanism 55.

Second Embodiment

Figure 13:
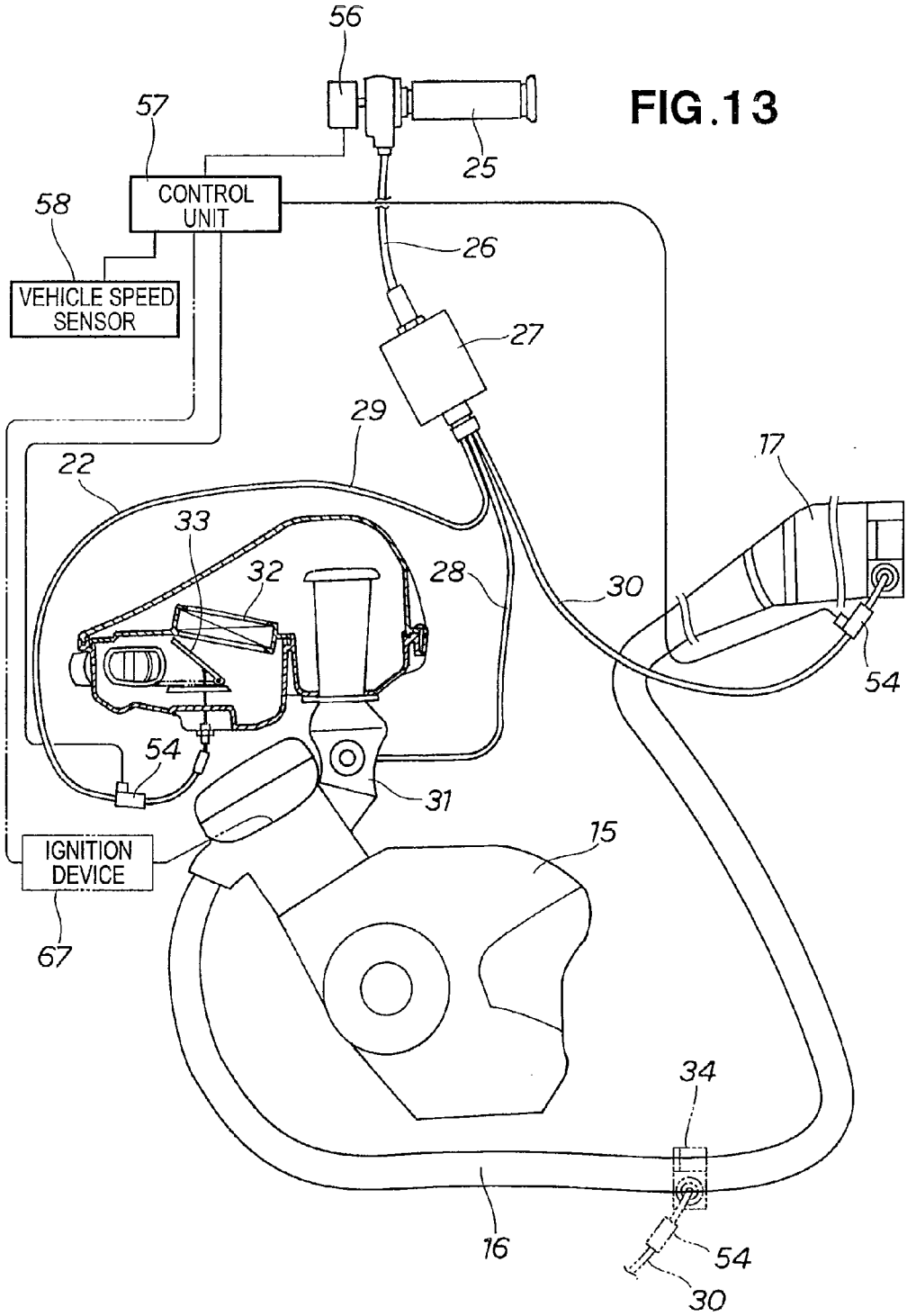
FIG. 13 is a diagrammatical view showing the general configuration of a noise-reduction device according to a second embodiment of the present invention.

A second embodiment of the present invention will next be described with reference to the drawings. As shown in FIG. 13, the throttle grip 25, which is adapted to be operated by the driver, is provided with a throttle ratio detection sensor 56 for detecting a throttle ratio of the throttle grip 25. Information about a throttle ratio that is detected by the throttle ratio detection sensor 56 is sent to a control unit 57. The control unit 57, on the basis of the throttle ratio information, determines whether or not the detected throttle ratio is in the range of zero to a predetermined value.

The control unit 57 obtains information about a vehicle speed from a vehicle speed sensor 58. The control unit 57, on the basis of the throttle ratio information and the vehicle speed information, switches a lost motion mechanism 54 between an operating state and a disabled or inoperative state.

Figure 14:
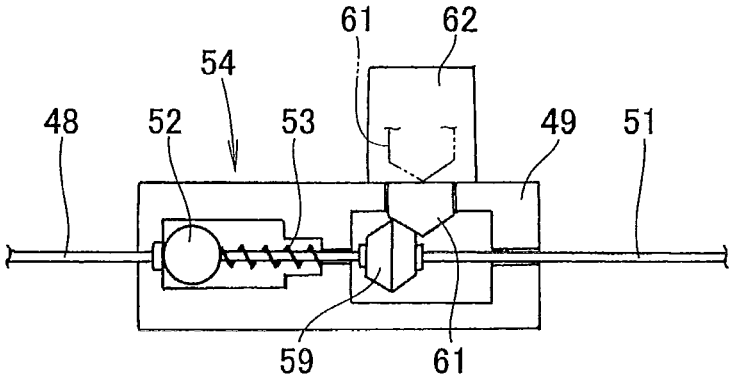
FIG. 14 is a diagrammatical view showing the principle of a lost-motion mechanism used in the second embodiment of the present invention.

As shown in FIG. 14, the lost motion mechanism 54 includes a case 49 connected to an end of a driving cable 48, a ball 52 connected to an end of a driven cable 51 and movably received in the case 49 such that the ball 52 is movable by a predetermined distance relative to the case 49, a return spring 53 urging the ball 52 to return to its original position, a striker 59 fixed to the driven cable 51, a stopper 61 engageable with the striker 59 to arrest movement of the striker 59 under a specific condition, and an electromagnetic valve 62 for driving the stopper 61 into and out of interlocking engagement with the striker 59. The specific condition will be described with reference to a flowchart shown in FIG. 15.

Figure 15:
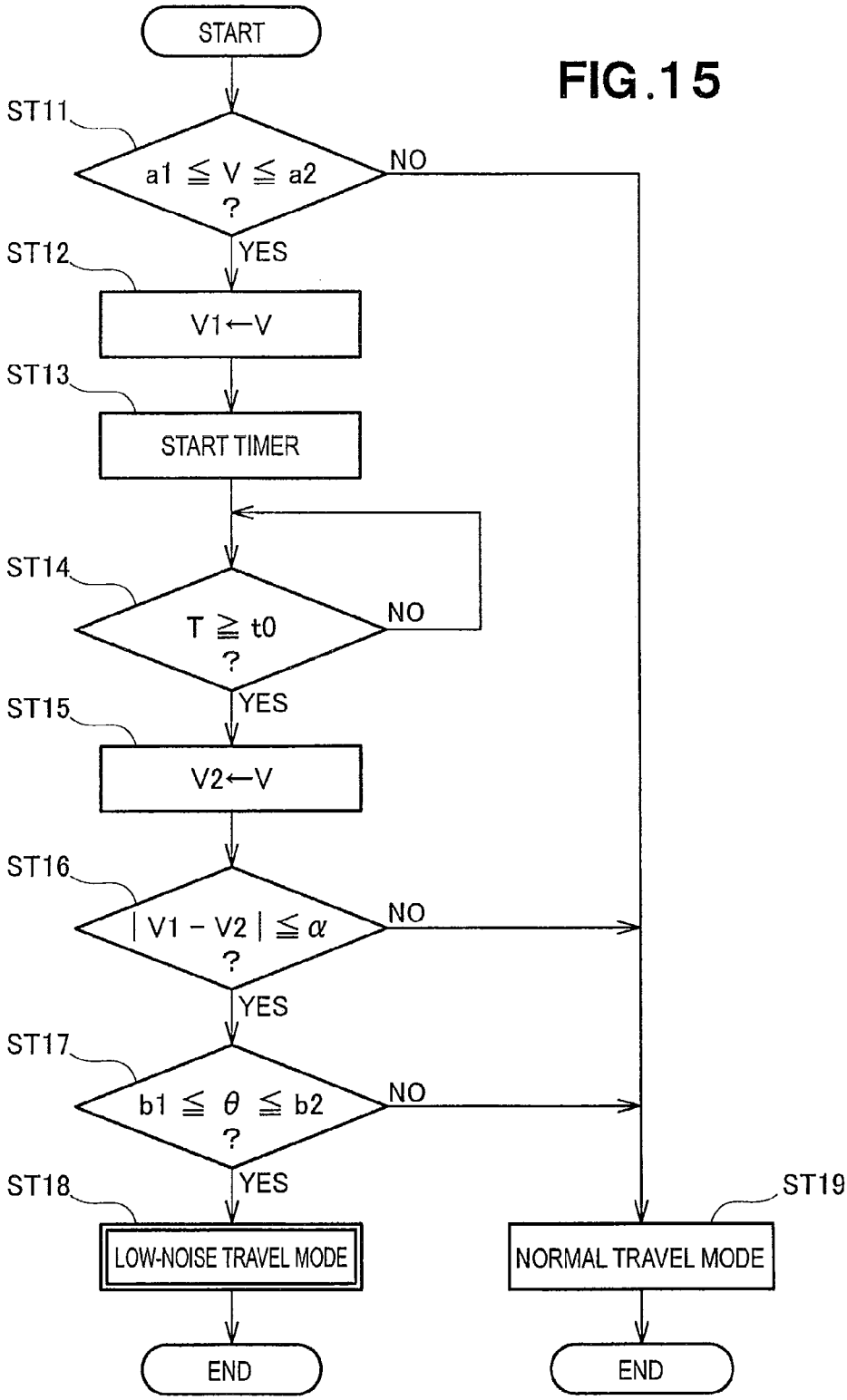
FIG. 15 is a flowchart showing a sequence of operations of the noise-reduction device according to the second embodiment of the present invention.

The flowchart shown in FIG. 15 illustrates a sequence of operations achieved by the control unit 57 shown in FIG. 13.

As shown in FIG. 15, a step (hereinafter abbreviated to "ST") 11, on the basis of a signal from the vehicle speed sensor 32 [sic], determines whether a travel speed of the two-wheeled motor vehicle is in the range of a1 to a2, where a1=25 km/h and a2=60 km/h, for example. A travel speed in the range of 25 to 60 is called "travel speed in urban areas".

If it is determined that the travel speed of the two-wheeled motor vehicle is in the range of a1 to a2, the process advances to ST12. Alternatively, if it is determined that the travel speed of the two-wheeled motor vehicle is not in the range of a1 to a2, the process jumps to ST19.

When an affirmation determination is made ("YES") at ST11, the control unit places the lost motion mechanism shown in FIG. 14 in the operative state. Alternatively, if a negative determination is made ("NO") at ST11, the control unit will place the lost motion mechanism shown in FIG. 14 in the disabled state.

The affirmative determination ("YES") at ST 11 is followed by a further determination as to whether the two-wheeled motor vehicle is now in an accelerated condition (or in a decelerated condition). As for the two-wheeled motor vehicles while being accelerated (or decelerated), the power output is given priority over other factors and, hence, no action will be taken to reduce noise during acceleration (or deceleration) of the two-wheeled motor vehicles. The determination as to whether the two-wheeled motor vehicle is now being accelerated (or decelerated) relies on the largeness of a difference between an initial speed V1 and a speed (final speed) V2 after the elapse of a certain period of time T.

Thus, an initial speed V1 of the two-wheeled motor vehicle is recorded at ST12, and a timer is started at ST13. The timer continues to count down until a preset time t0 elapses (ST14).

Figure 16:
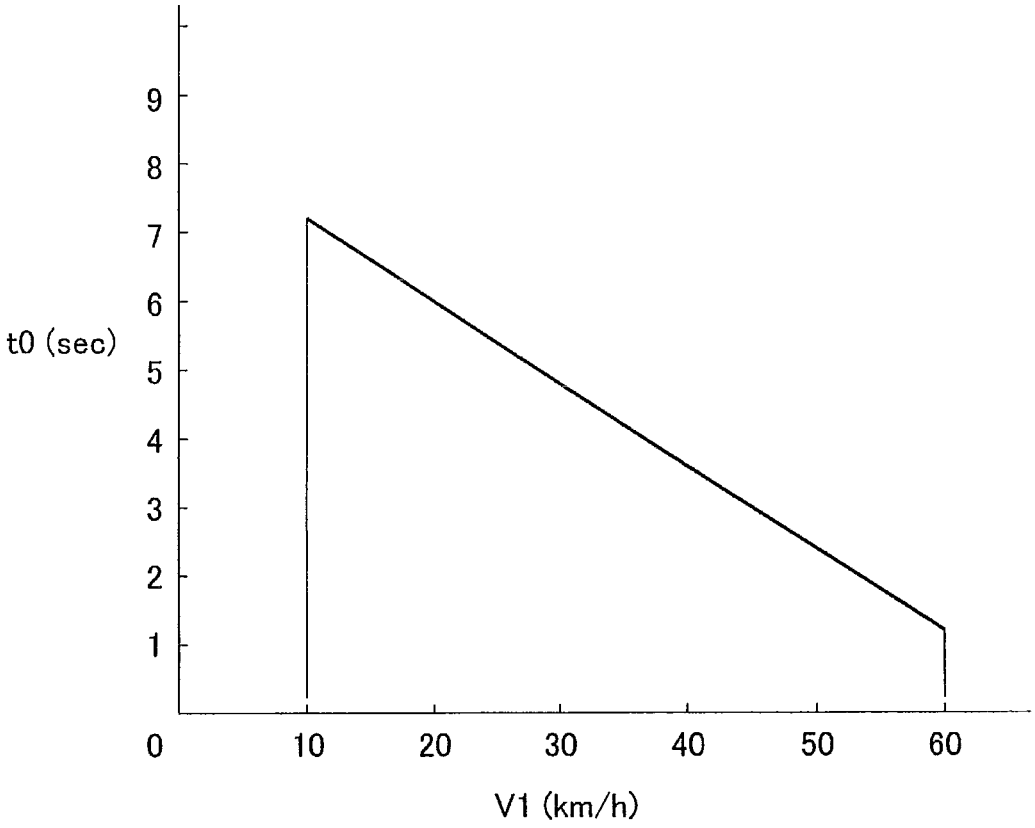
FIG. 16 is a graph showing the correlation between the initial velocity and the time.

The preset time t0 is determined by, for example, a graph shown in FIG. 16. When the initial speed V1 is large, a variation in speed is remarkable and, hence, the preset time t0 can be set to a short time. Alternatively, when the initial speed V1 is small, a variation in speed is small and, hence, the preset time t0 need to be set to a long time.

When the preset time t0 elapses, ST15 records a final speed V2. Subsequently, at ST16, a difference between the initial speed V1 and the final speed V2 is calculated. If (V1−V2) is a negative value, this means that the two-wheeled motor vehicle is in an accelerated condition. Alternatively, if (V1−V2) is a positive value, this means that the two-wheeled motor vehicle is in a decelerated condition. Furthermore, if the absolute value of (V1−V2) is equal to or smaller than a predetermined value ∀, it is determined that the two-wheeled motor vehicle is not in an accelerated condition (or in a decelerated condition) at ST16. The predetermined value ∀ is, for example, 1.5 km/h.

If a negative determination is made ("NO") at ST16, this means that the two-wheeled motor vehicle is in an accelerated condition (or in a decelerated condition). Thus, the noise-reduction device is not operated. This state of operation is called "normal travel mode" (ST19).

Alternatively, if an affirmative determination is made ("YES") at ST16, this means that the two-wheeled motor vehicle is not in an accelerated condition (or in a decelerated condition). Then the process goes on to ST17, which determines as to whether the throttle ratio 2 of the throttle grip is in the range of b1 to b2 where b1 corresponds to zero and b2 corresponds to a predetermined value.

If a negative determination is made ("NO") at ST17, the noise-reduction device is not operated (ST19).

Alternatively, if an affirmative determination is made ("YES") at ST17, the noise-reduction device is operated. This mode of operation is called "low-noise travel mode" (ST18).

A single cycle of operations of the noise-reduction device has thus been completed.

A noise control unit 80 is configured to achieve a noise reduction effect most efficiently when the following three conditions are fulfilled: (a) the vehicle speed is within a predetermined speed range (a1 to a2), (b) a variation in speed is equal to or smaller than a predetermined value (∀), and (c) the throttle ratio is within a predetermined range (b1 to b2).

Third Embodiment

Figure 17:
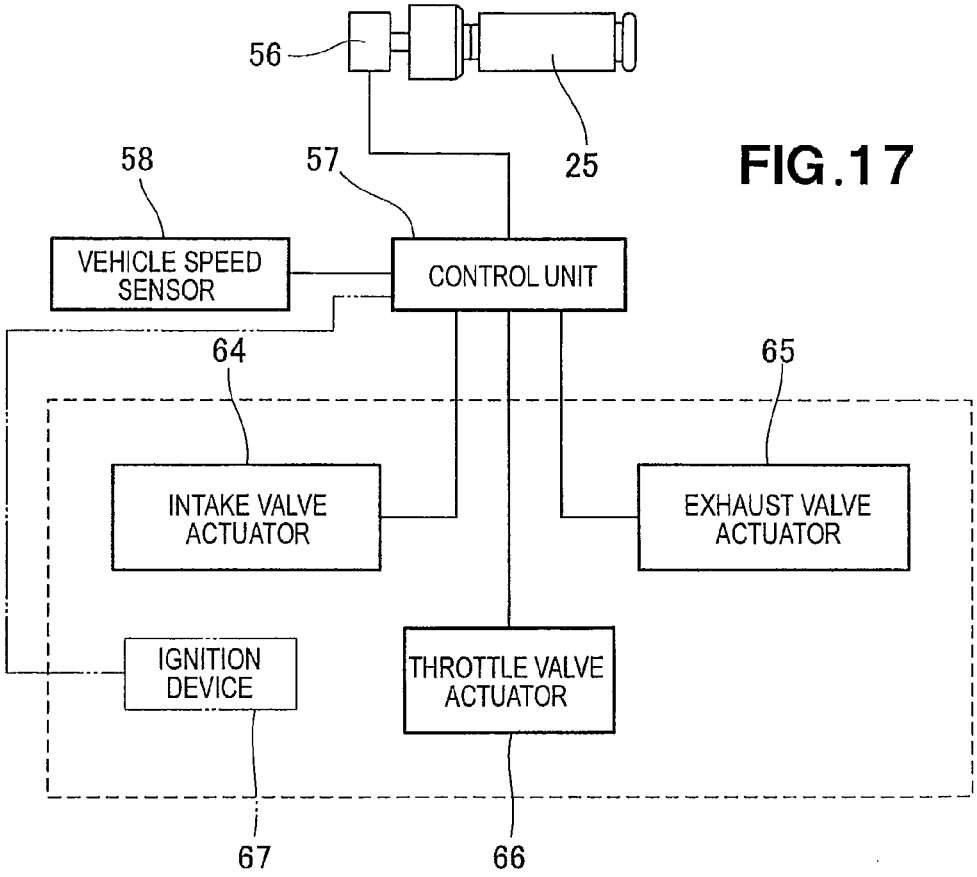
FIG. 17 is a block diagram showing the general configuration of a noise-reduction device according to a third embodiment of the present invention.

The main cable 26, junction box 27, first to third cables 28-30, and lost-motion mechanisms 54 that are shown in FIG. 13 can be omitted by computerization. One form of such computerization will be described below as a third embodiment with reference to the accompanying drawings. As shown in FIG. 17, this embodiment comprises an intake valve actuator 64 for driving the intake valve, an exhaust valve actuator 65 for driving the exhaust valve, and a throttle valve actuator 66 for driving the throttle valve.

The control unit 57, on the basis of throttle ratio information from the throttle ratio detection sensor 56, operates the throttle valve actuator 66 to adjust the degree of opening of the throttle valve.

Furthermore, the control unit 57, based on vehicle speed information from the vehicle speed sensor 58 and the throttle ration information from the throttle ratio detection sensor 56, operates the intake valve actuator 64 and the throttle valve actuator 66 so as to execute the low-noise travel mode (ST18 shown in FIG. 14) when the conditions are fulfilled.

Figure 18:
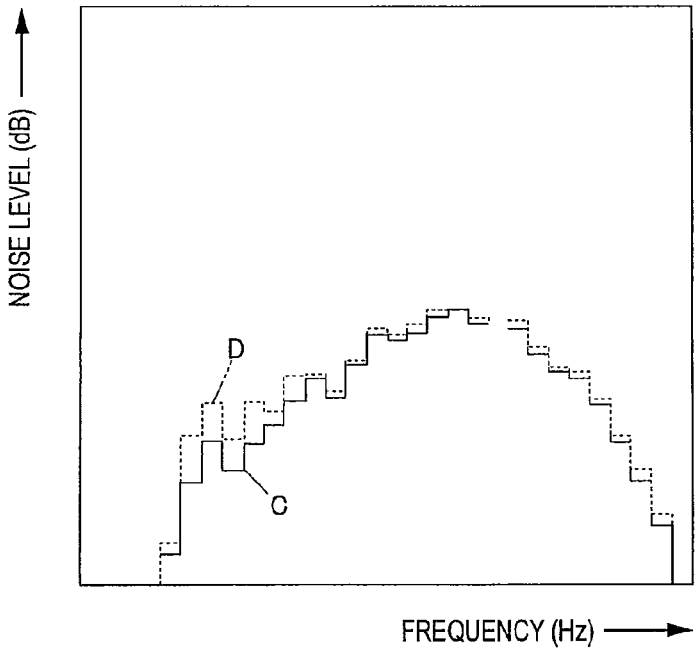
FIG. 18 is a graph explanatory of the effects achieved by advancing the ignition timing.

The control unit 57 sends a signal to an ignition device 67 so as to control ignition timing of the engine. FIG. 18 shows a histogram C indicated by solid lines illustrative of the relation between the frequency and the noise level observed when the ignition is performed with spark-advancing control and a histogram D indicated by broken lines illustrative of the relation between the frequency and the noise level observed when the ignition is performed without spark-advancing control. As evidenced by the solid-lined histogram C shown in FIG. 18, a lower noise level is achieved when the ignition is performed with the spark-advance control employed.

The reason for such lower noise level may be considered as follows. When the two-wheeled motor vehicle is not in an accelerated condition, the engine load is low and, hence, the degree of opening of the throttle valve is small, thereby reducing the amount of fuel gas supplied to the combustion chamber. In this instance, if the ignition timing is advanced, a smaller amount of fuel gas will be subjected to combustion for a longer time than as usual. As a consequence, only a reduced amount of unburned gas is produced, which can eliminate combustion in the exhaust passage, thereby lowering the noise.

The present invention is particularly suitable for application in a two-wheeled motor vehicle designed for the travel in an urban area.

LEGEND

10: two-wheeled motor vehicle, 11: body frame, 15: engine, 16: exhaust passage, 17: muffler, 19: rear wheel, 23: intake device, 25: throttle grip, 31: throttle valve, 33: intake valve, 34: exhaust valve, 67: ignition device

The invention claimed is:

1. A two-wheeled motor vehicle, comprising:

a body frame;

an engine mounted to the body frame for driving a rear wheel;

an exhaust passage extending from the engine for discharging exhaust gas from the engine;

a muffler provided at an outlet of the exhaust passage for reducing exhaust noise;

an intake passage connected to the engine for supplying intake air into the engine;

a throttle valve disposed in the intake passage for adjusting the amount of fuel gas to be supplied to the engine;

a throttle grip rotatable by the driver to change the degree of opening of the throttle valve; and a noise-reduction device which, when a throttle ratio which is a ratio of the angle of operation of the throttle grip to a maximum rotation angle of the throttle grip is between zero and a predetermined value, reduces noise emitted from the engine, wherein said noise-reduction device comprises a control unit configured to achieve a noise reduction effect most efficiently when the following three conditions are fulfilled: (a) the vehicle speed is within a predetermined speed range, (b) a variation in speed is equal to or smaller than a predetermined value, and (c) the throttle ratio is within a predetermined range wherein the noise reduction device comprises an exhaust valve connected to and driven by the throttle grip via a cable, the exhaust valve being configured to change a cross-sectional area of the exhaust passage and also to reduce the noise most efficiently when the exhaust valve has a minimum degree of opening, wherein the noise-reduction device further comprises a lost motion mechanism incorporated in the cable between the throttle grip and the exhaust valve and configured to provide a lag in motion transmitted from the throttle grip to the exhaust valve such that when the throttle ratio is in a range of from zero to the predetermined value, the exhaust valve continues to retain the minimum degree of opening, and wherein the lost motion mechanism is switchable between an operable state and a disabled state, and the lost motion mechanism includes an electromagnetic valve configured to switch the lost motion mechanism between the operable state and the disabled state.

2. The two-wheeled motor vehicle as claimed in claim 1, wherein the noise-reduction device comprises an intake valve which is configured to change a cross-sectional area of the intake passage and also to reduce the noise most efficiently when the intake valve has a minimum degree of opening.

3. The two-wheeled motor vehicle as claimed in claim 2, wherein the minimum degree of opening of the intake valve is a degree of opening corresponding to a valve-opening area which is 30 to 60% of a valve-opening area achieved when the intake valve is fully opened.

4. The two-wheeled motor vehicle as claimed in claim 2, wherein the intake valve is connected by and driven by the throttle grip via a second cable, wherein the noise-reduction device further comprises a second lost motion mechanism incorporated in the second cable and configured to provide a lag in motion transmitted from the throttle grip to the intake valve such that when the throttle ratio is in a range of from zero to the predetermined value, the intake valve continues to retain the minimum degree of opening, and wherein the second lost motion mechanism is switchable between an operable state and a disabled state, and the second lost motion mechanism includes a second electromagnetic valve configured to switch the second lost motion mechanism between the operable state and the disabled state.

5. The two-wheeled motor vehicle of claim 4, wherein the exhaust valve is built in the muffler or disposed in an intermediate portion of the exhaust passage.

6. The two-wheeled motor vehicle as claimed in claim 1, wherein the noise-reduction device comprises an ignition device which is configured to advance ignition timing when the throttle ratio is between zero and the predetermined value.

7. The two-wheeled motor vehicle as claimed in claim 1, wherein the predetermined value of the throttle ratio is 5 to 25%.

8. The two-wheeled motor vehicle as claimed in claim 1, wherein the minimum degree of opening of the exhaust valve is a degree of opening corresponding to a valve-opening area which is 15 to 35% of a valve-opening area achieved when the exhaust valve is fully opened.

9. The two-wheeled motor vehicle as claimed in claim 1, wherein the condition (b) means that the difference between an initial speed and a final speed after the lapse of a preset time is equal to or smaller than a predetermined change in vehicle speed, and wherein the preset time has a property of becoming progressively shorter as the initial speed becomes higher.

10. The two-wheeled motor vehicle of claim 1, wherein the exhaust valve is built in the muffler or disposed in an intermediate portion of the exhaust passage.

* * * * *